US009080371B2

(12) United States Patent
Wilkins

(10) Patent No.: US 9,080,371 B2
(45) Date of Patent: Jul. 14, 2015

(54) SECURITY SCREEN

(76) Inventor: Brian Malcolm Wilkins, Retford (GB)

( * ) Notice: Subject to any disclaimer, the term of this patent is extended or adjusted under 35 U.S.C. 154(b) by 0 days.

(21) Appl. No.: 13/519,359

(22) PCT Filed: Dec. 23, 2010

(86) PCT No.: PCT/GB2010/052207

§ 371 (c)(1),
(2), (4) Date: Jun. 27, 2012

(87) PCT Pub. No.: WO2011/080516

PCT Pub. Date: Jul. 7, 2011

(65) Prior Publication Data

US 2012/0297968 A1 Nov. 29, 2012

(30) Foreign Application Priority Data

Dec. 30, 2009 (GB) ..... 0922689.5

(51) Int. Cl.
*F41H 5/013* (2006.01)
*E06B 5/12* (2006.01)
*E06B 9/28* (2006.01)

(52) U.S. Cl.
CPC .... *E06B 5/12* (2013.01); *E06B 9/28* (2013.01)

(58) Field of Classification Search
CPC ..... F41H 5/013; F41H 5/06; F41H 5/26; E06B 5/12
USPC ..... 89/36.01, 36.03; 49/56, 64, 61, 74.1; 109/49.5
See application file for complete search history.

(56) References Cited

U.S. PATENT DOCUMENTS
4,215,517 A 8/1980 Everson
4,325,309 A * 4/1982 King et al. ..... 109/49.5
(Continued)

FOREIGN PATENT DOCUMENTS
GB 2161198 A 1/1986
GB 2247475 A 4/1992
(Continued)

OTHER PUBLICATIONS
PCT Search Report dated May 3, 2011 of Patent Application No. PCT/GB2010/052207 filed Dec. 23, 2010.
Search Report for GB0922689.5 dated Mar. 10, 2010, 4 pages.

*Primary Examiner* — Samir Abdosh
*Assistant Examiner* — John D Cooper
(74) *Attorney, Agent, or Firm* — Maine Cernota & Rardin

(57) ABSTRACT

A security screen (5) comprises: a shutter frame (6) securable in a window opening (1) in a building, with a first side facing the window and a reverse side facing away from the window inwardly of the building; a plurality of parallel blades (7) extending across the shutter frame (6), each said blade having in cross-section a shape which includes a point at each opposed edge of the blade and having a reinforcing axial member (8) extending therethrough and engaged in respective opposing sides of the shutter frame, the blades being linked together and rotatable such that rotation of one blade induces the other blades to rotate simultaneously between a closed position, in which the blades lie substantially parallel to the frame so as to form a continuous shutter, and an open position substantially normal to the closed position; and a sheet of transparent plastic material (10) mounted on the frame and extending across the frame at a predetermined distance from the edges of the blades when in the open position thereof whereby, in the event of an explosion outside the window causing a pressure wave to blow the window inwardly of the building, the plastic material contacts at least a portion of a pointed edge of at least one of the blades when in the open position to rotate to the closed position, thereby preventing ingress of the pressure wave and glass from the window into the building.

3 Claims, 2 Drawing Sheets

(56) References Cited

U.S. PATENT DOCUMENTS

| | | | | |
|---|---|---|---|---|
| 4,967,509 | A * | 11/1990 | Storey et al. | 49/74.1 |
| 5,430,981 | A | 7/1995 | Scott | |
| 5,787,642 | A * | 8/1998 | Coyle et al. | 49/61 |
| 6,061,962 | A * | 5/2000 | Sosa | 49/249 |
| 2005/0266187 | A1 | 12/2005 | Smith et al. | |
| 2007/0101651 | A1 | 5/2007 | Nien | |
| 2009/0272037 | A1 * | 11/2009 | Sosa | 49/74.1 |

FOREIGN PATENT DOCUMENTS

| | | | |
|---|---|---|---|
| GB | 2443826 | A | 5/2008 |
| WO | 01/33022 | A2 | 5/2001 |
| WO | 02/06620 | A1 | 1/2002 |
| WO | 03/091526 | A2 | 11/2003 |
| WO | 2008/059265 | A1 | 5/2008 |
| WO | WO 2008059265 | A1 * | 5/2008 |

* cited by examiner

SECURITY SCREEN

RELATED APPLICATIONS

This application is a national phase application filed under 35 USC §371 of PCT Application No. PCT/GB2010/052207 with an International filing date of 23 Dec. 2010 which claims priority to United Kingdom Patent Application No. GB0922689.5, filed 30 Dec. 2009. Each of these applications is herein incorporated by reference in their entirety for all purposes

FIELD OF THE INVENTION

This invention relates to a security screen for preventing unauthorised access to a building and for protecting the occupants of the building from external bomb blast.

BACKGROUND TO THE INVENTION

Security screens typically prevent unauthorised access to buildings through windows or doors, but often result in a prison-like appearance not compatible with ordinary office or other usage. In addition, some buildings, because of their location or the nature of the organisation occupying the building, are vulnerable to terrorist attack by explosives set off in front of the building.

WO 2002/006620 discloses a combination window blind and shutter which provides the advantages of high security combined with the appearance of ordinary vertical blinds. An additional advantage with this arrangement was found to be the possibility of automatic protection from bomb blast, inward movement of the window being protected causing the blind to close rapidly, thus reducing the risk of injury to the occupants of the building from broken glass and from the effects of the blast. These effects are enhanced by the combination of a sheet or film of plastics material extending between the window glass and the screen, as disclosed in WO 2008/059265. In order to ensure the maximum effectiveness of the use of the plastics sheet, it is necessary to space it accurately in relation to the blades of the blind, and there is a risk that incorrect installation would render the blind less effective. Also, the installation of the screen or blind may result in a reduced usability of the window or door, because of the need to install the additional plastics sheet.

SUMMARY OF THE INVENTION

The present invention provides a security screen comprising:

a shutter frame securable in a window opening in a building, with a first side facing the window and a reverse side facing away from the window inwardly of the building;

a plurality of parallel blades extending across the shutter frame, each said blade having in cross-section a shape which includes a point at each opposed edge of the blade and having a reinforcing axial member extending therethrough and engaged in respective opposing sides of the shutter frame, the blades being linked together and rotatable such that rotation of one blade induces the other blades to rotate simultaneously between a closed position, in which the blades lie substantially parallel to the frame so as to form a continuous shutter, and an open position substantially normal to the closed position;

and a sheet of transparent plastic material mounted on the frame and extending across the frame at a predetermined distance from the edges of the blades when in the open position thereof whereby, in the event of an explosion outside the window causing a pressure wave to blow the window inwardly of the building, the plastic material contacts at least a portion of a pointed edge of at least one of the blades when in the open position to rotate to the closed position, thereby preventing ingress of the pressure wave and glass from the window into the building.

Preferably, the plastic material is a polycarbonate material resistant to shattering. The sheet is preferably held in a frame formed from an F-section extrusion, the lower leg of the F serving to space the sheet from the body of the shutter frame.

The screen of the invention is conveniently in modular form, which eases installation in a window or door opening, while ensuring the correct automatic closure of the blind in the event of an explosion outside the building.

Another aspect of the invention provides a storm protection screen mountable externally of a building across a window or door opening therein, the screen comprising a shutter frame, a plurality of parallel blades extending across the shutter frame, each said blade having in cross-section a shape which includes a point at each opposed edge of the blade and having a reinforcing axial member extending therethrough and engaged in respective opposing sides of the shutter frame, the blades being linked together and rotatable such that rotation of one blade induces the other blades to rotate simultaneously between a closed position, in which the blades lie substantially parallel to the frame so as to form a continuous shutter, and an open position substantially normal to the closed position, and means on the frame for receiving a locking bar across the frame extending in a direction normally to the axes of rotation of the blades whereby to prevent rotation of the blades from the closed positions thereof.

Preferably, the locking bar is mountable between the blades and the building.

In use, when there is a risk of a storm such as a hurricane or tornado, the blades are rotated to the closed positions thereof, and the locking bar is positioned across the frame to prevent rotation of the blades in the event of debris striking the screen. In this way, the window or door is protected from damage.

While the screen has been described with reference to protection of building occupants from the effects of blasts external to the building, another possible application of the screens is in the protection of the surroundings from the effects of an explosion within a room of a building, for example a post room or a laboratory. By installing the screen on the exterior of a glazed window with the plastics sheet facing inwardly of the building or room, the damaging effects to the exterior of an explosion within the room can be minimised, the blind automatically closing as the explosion occurs.

The screen could be installed within a window opening without the need for additional glazing, the plastics sheet serving as the window in normal use, or an enclosure could be formed partially or completely from the screens.

Yet another aspect of the invention therefore provides a blast enclosure, comprising a plurality of security screens secured together to define the walls and roof of the enclosure, each said screen comprising:

a shutter frame;

a plurality of parallel blades extending across the shutter frame, each said blade having in cross-section a shape which includes a point at each opposed edge of the blade and having a reinforcing axial member extending therethrough and engaged in respective opposing sides of the shutter frame, the blades being linked together and rotatable such that rotation of one blade induces the other blades to rotate simultaneously between a closed position, in which the blades lie substantially parallel to the frame so as to form a continuous shutter, and an open position substantially normal to the closed position;

and a sheet of transparent plastic material mounted on the frame and extending across the frame at a predetermined distance from the edges of the blades when in the open position thereof whereby, in the event of an explosion within the enclosure causing a pressure wave to distort the sheet outwardly of the enclosure, the plastic material contacts at least a portion of a pointed edge of at least one of the blades when in the open position to rotate to the closed position, thereby preventing escape of the pressure wave from the enclosure to the surroundings.

Such an enclosure could be installed within a building to serve as a post room, a laboratory, or an enclosure for a potentially hazardous process, for example using an oven or boiler or the like.

BRIEF DESCRIPTION OF THE DRAWINGS

In the drawings, which illustrate exemplary embodiments of the invention.

DETAILED DESCRIPTION OF THE ILLUSTRATED EMBODIMENT

Figure 1:
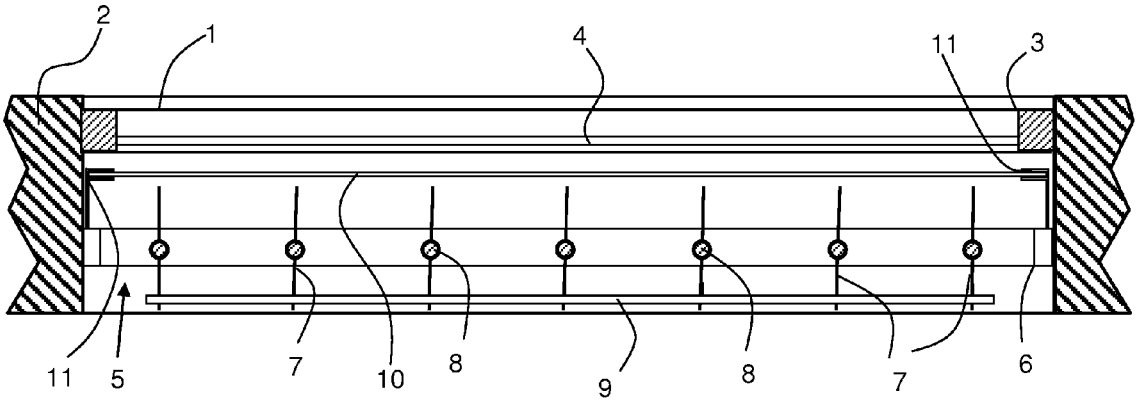
FIG. 1 is a sectional plan view through a window having a screen according to one embodiment.

Referring first to FIG. 1, a window opening 1 in a building 2 has a window frame 3 mounted therein in conventional manner, the window frame mounting a glass sheet 4 (alternatively, a sealed double-glazing unit could be used). A combined defence shutter and window blind 5 (hereinafter referred to as a screen) is also mounted within the window opening 1, inside the building relative to the window 3, 4. The screen 5 consists of a primary frame 6 which may be mounted in the window opening 1 so as to hinge open (the hinge mounting is not shown in the drawing, for the sake of simplicity), for example for access to the window for cleaning and maintenance or for emergency egress from the building. A plurality of parallel vertical blades 7 are mounted within the frame. Each blade 7 has a steel reinforcing rod 8 passing therethrough, the rods 8 being secured in the frame in such a manner as to permit rotation of the blades around the longitudinal axis of the rods. The blades 7 are shaped so as to disguise the presence of the rods 8 and to give the appearance of conventional vertical blinds. In cross-section, the blades narrow down to substantially a point on each side of the rod, providing thin edges along the blades. The blades may be linked together by cords or chains so that, when one blade is rotated, all the other blades are caused to rotate simultaneously, but are preferably linked together by a linking bar 9. In this way, the blades may be rotated between a fully open position, in which the blades extend substantially normally to the window glass 4, as illustrated in FIG. 1, and a closed position, in which the blades extend substantially parallel to the window glass 4, overlapping to form a continuous shutter. Cord and pulley means are provided in conventional manner to permit rotation of the blades selectively between their open and closed positions, for example to control ingress of sunlight to the building or for privacy.

The screen is provided with a sheet 10 of an anti-shatter material mounted in a secondary frame 11 extending from the primary frame 6 so as to be positioned between the blades 7 and the window glass 4. The anti-shatter material may comprise a sheet of transparent polycarbonate plastics material. The secondary frame 11 is formed from a generally F-shaped profile in which the two horizontal legs of the F define a channel in which the sheet is secured, for example by adhesive, while the vertical member of the F serves to mount the secondary frame on the main frame at the correct distance therefrom.

The anti-shatter material distorts in the event of an impact on the window glass 4 driving the glass inwardly of the building against the sheet, absorbing some energy, but serves to hold the window glass together in the event of the window breaking. Positioning the sheet 10 correctly relative to the blades 7 ensures that, in the event of an explosion outside the building, the blind is automatically closed quickly enough to prevent broken glass entering the building and to resist the effects of the explosive pressure wave, thereby protecting any occupants of the building from any injury.

Figure 2:
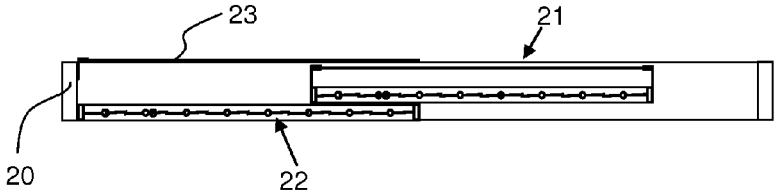
FIG. 2 is a sectional plan view through a screen according to another embodiment.

FIG. 2 illustrates an alternative configuration, in which access to an opening window, for example sliding glass patio doors, is provided by making the screen in two or more sections, mounted in a supporting frame 20, at least one of the sections 21 being slidably mounted within the supporting frame, while the other section 22 is fixed. It will be appreciated that one possible configurations would comprise a fixed section at each side of the supporting frame and two sliding sections at the centre movable outwardly to provide access to the centre of the window/door opening.

Referring to the example in FIG. 2, the slidable section 21 is of the general configuration described with reference to FIG. 1, and the sheet 10 of polycarbonate material is integral with the section to slide with it. The fixed section 22 has its sheet 23 located on the supporting frame 20, spaced a sufficient distance in from of the blades to permit the slidable section to slide between it and the fixed section when the unit is opened. It will be understood that, in order to permit sliding to take place, both screens must have the blades 7 rotated to the closed positions thereof, as illustrated in FIG. 2. The Figure shows the slidable section 21 in the process of being slid open to expose the associated window (not shown) at one side thereof.

Figure 3:
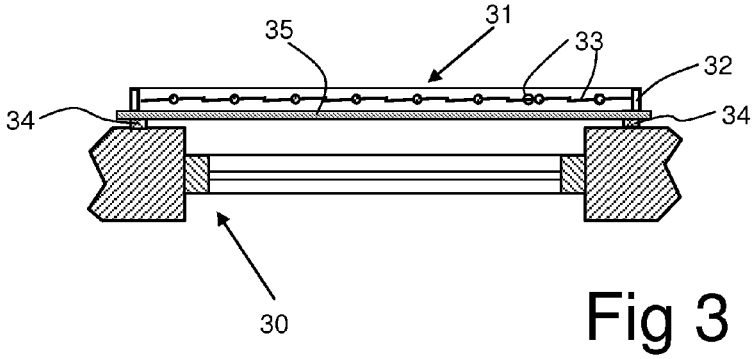
FIG. 3 is a sectional plan view of a window opening in a building with a storm protection screen according to another aspect of the invention installed over it.

FIG. 3 illustrates another aspect of the invention, in which a window or other opening 30 in a building is protected from the effects of a storm by an external screen 31 of the same general type as described herein with respect to the first aspect of the invention. The screen has a frame 32 in which a series of reinforced blades 33 as hereinbefore described are mounted at intervals, the blades 33 being linked together and rotatable together between an open, or indeed partially-open, position, in which they admit light and air to the building, and a fully-closed position, in which a protective screen is formed across the window, preventing not only unauthorised access, but also damage to the window by flying debris thrown up by a storm. The screen is mounted on mounts 34 spacing it from the external face of the building the mounts being adapted to receive a locking bar 35 across the inward face of the screen when it is closed, preventing rotation of the blades, and thereby ensuring that the window is securely protected. The locking bar 35 may be secured in place by means of a secure fastening arrangement that permits the bar 35 to be inserted and secured from one side edge of the frame.

Figure 4:
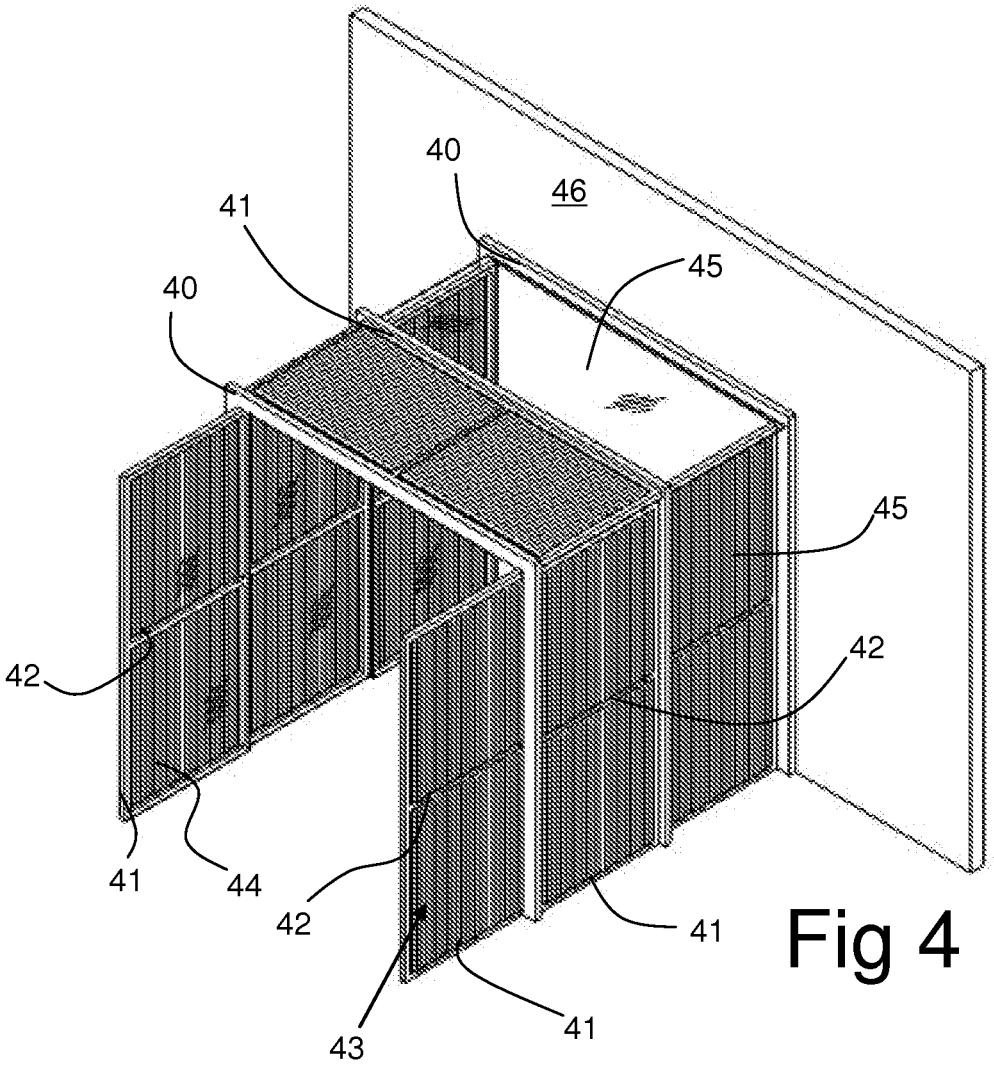
FIG. 4 is a perspective view of a safety enclosure according to another aspect of the invention.

Referring now to FIG. 4, which shows the use of security screens according to the invention in a blast enclosure, for example for the handling of suspected explosive devices, or potentially explosive materials in a laboratory or the like, or surrounding a boiler or oven for industrial processes. The enclosure consists of a series of steel portal frames 40, spaced apart at intervals along the length of the enclosure according to the desired length. In the illustrated example in FIG. 4, just two frames 40 are used. The enclosure is then built up from standard screen units of the type illustrated in FIGS. 1 and 2, consisting of a frame 41, divided by a cross-member 42 into two equal portions, each of which mounts a series of parallel rotatable blades 43. A polycarbonate sheet 44 is then mounted on the frame on the inwardly-facing side thereof, in the manner described with reference to FIGS. 1 and 2. The frames 41 are then secured together to form the sides and top of the enclosure, between the portal frames 40, while at one end a pair of frames are hingedly mounted to form doors giving access to the interior of the enclosure. The view in FIG. 4 shows only one set of frames 41 in position, for the sake of clarity. The positions of the other set of frames making up the top and two opposed sides of the enclosure are indicated by polycarbonate sheets 45, but in practice these are not installed separately, being integral parts of the frames.

The enclosure in FIG. 4 is illustrated as being installed against a wall 46, which could be an interior wall of a building, for example. However, it will be appreciated that the enclosure could be free-standing, with a rear wall formed in a similar manner to the remainder of the enclosure, using the standard screen units.

In use, with the doors closed, the enclosure affords views of the interior from without, and views of the exterior from within, thereby avoiding the feeling for users of working in a closed box. In the event of an explosion within the enclosure, the polycarbonate sheets bow outwardly, contacting at least some of the blades and causing them to rotate to a closed position, all the blades in one section of a frame 41 being linked together so as to rotate simultaneously. The blast is thus contained within the enclosure. It will be appreciated that blast panels will need to be incorporated into the enclosure to allow controlled release of the blast in a safe direction.

The invention claimed is:

1. A security screen comprising:

a primary shutter frame securable in a window opening in a building, said window opening having a window with at least one window pane mounted therein, said primary shutter frame having a first side facing the window pane and a reverse side facing away from the window pane inwardly of the building;

a plurality of parallel blades extending across the primary shutter frame, each said blade having in cross-section a shape which includes a point at each opposed edge of the blade and having a reinforcing axial member extending there through and engaged in respective opposing sides of the primary shutter frame, the blades being linked together and rotatable such that rotation of one blade induces the other blades to rotate simultaneously between a closed position, in which the blades lie substantially parallel to the frame so as to form a continuous shutter, and an open position substantially normal to the closed position; and sheet of transparent plastic material mounted in a secondary frame extending from the primary frame and extending across the primary frame so as to be positioned between the window and the edges of the blades when in the open position thereof whereby, in the event of an explosion outside the window causing a pressure wave to blow the window pane inwardly of the building into contact with the sheet of plastic material, the plastic material contacts at least a portion of a pointed edge of at least one of the blades when in the open position to rotate to the closed position, thereby preventing ingress of the pressure wave and glass from the window into the building; and wherein the secondary frame is connected to the primary shutter frame and the secondary frame is separated from the window.

2. A security screen according to claim 1, wherein the plastic material is a polycarbonate material resistant to shattering.

3. A security screen according to claim 1, wherein the sheet is held in said secondary frame formed from an F-section extrusion, the lower leg of the F serving to space the sheet from a body of the primary shutter frame.

* * * * *